US011246792B2

(12) United States Patent
Held

(10) Patent No.: US 11,246,792 B2
(45) Date of Patent: Feb. 15, 2022

(54) WALL-MOUNTED MASSAGE DEVICE

(71) Applicant: Joan Mary Held, Oxford, FL (US)

(72) Inventor: Joan Mary Held, Oxford, FL (US)

( * ) Notice: Subject to any disclaimer, the term of this patent is extended or adjusted under 35 U.S.C. 154(b) by 342 days.

(21) Appl. No.: 16/661,082

(22) Filed: Oct. 23, 2019

(65) Prior Publication Data

US 2021/0121357 A1 Apr. 29, 2021

(51) Int. Cl.
*A61H 15/00* (2006.01)
*A61H 7/00* (2006.01)

(52) U.S. Cl.
CPC ..... *A61H 15/00* (2013.01); *A61H 7/001* (2013.01); *A61H 2015/005* (2013.01); *A61H 2201/0126* (2013.01); *A61H 2201/0192* (2013.01)

(58) Field of Classification Search
CPC .. A61H 7/001; A61H 15/00; A61H 2015/005; A61H 2201/0123; A61H 2201/0126; A61H 2201/0192; A61H 2201/1253; A61H 2201/1685; A47B 57/16; A47B 57/20; A47B 57/22; A47B 57/40; A47B 57/406; A47B 57/42; A47B 57/48; A47B 57/482; A47B 57/485; A47B 57/487; A47B 57/50; A47B 57/52; F13M 13/02
See application file for complete search history.

(56) References Cited

U.S. PATENT DOCUMENTS 4,832,006 A 5/1989 Kirsch
5,094,225 A 3/1992 Craw
5,174,282 A 12/1992 Bieggi
6,090,055 A 7/2000 Frajdenrajch
7,645,248 B2 1/2010 Brown
D825,770 S * 8/2018 Siemer ..... A61H 7/001 D24/211
2002/0193715 A1 12/2002 Slack
2008/0139981 A1* 6/2008 Walquist ..... A61H 7/001 601/134
2011/0021959 A1 1/2011 Brown
2011/0237990 A1* 9/2011 Marsten ..... A61H 15/00 601/119
2012/0028765 A1* 2/2012 Morin ..... A63B 23/1218 482/91
2016/0058656 A1* 3/2016 Harvel ..... A61H 15/0092 601/122
2016/0324717 A1* 11/2016 Burton ..... A61H 7/001
2019/0015288 A1* 1/2019 Merrill ..... A61H 7/00
2019/0274914 A1* 9/2019 Hunter ..... A61F 7/007

* cited by examiner

*Primary Examiner* — Colin W Stuart
*Assistant Examiner* — Douglas Y Sul
(74) *Attorney, Agent, or Firm* — Peter J. Rashid

(57) ABSTRACT

A wall-mounted massage device includes a mounting member having a front surface, a rear surface opposite the front surface, a first side surface, a second side surface opposite the first side surface, a first end, and a second end opposite the first end. A groove is formed in the rear surface of the mounting member and exposes each aperture of the mounting member. The massage device also includes one or more accessories capable of being removably mounted to the mounting member. To removably mount each accessory to the mounting member, each accessory includes an accessory mounting part that is complimentary in shape to one or more apertures formed in the front surface of the mounting member. In one embodiment, the accessory mounting part is a peg or plug that can be at least partially received within the one or more apertures.

17 Claims, 9 Drawing Sheets

WALL-MOUNTED MASSAGE DEVICE

FIELD OF THE INVENTION

The invention relates, in general, to massage devices and, more particularly to a wall-mounted massage device that enables a person to selectively mount one or more accessories, such as a roller massager, a single point massager, a skin brush, a lotion applicator, and the like, to the device.

BACKGROUND OF THE INVENTION

As is appreciated by physical therapists, massage involves the manipulation of muscle and connective tissue to enhance the function of those tissues and promote relaxation and well-being. Therapeutic massage can ease tension and reduce pain, and can also be highly effective for reducing the symptoms of arthritis, back pain, and other disorders of the muscles and/or nervous system. Massage is generally administered either by another person (such as, for example, a massage therapist) or is self-administered by means of a mechanical massaging device.

Over the years, a variety of massage devices have been invented and marketed to those desirous of a self-administered massage. Although a vast variety of self-administered massage devices, such as back massagers, foot massagers, and the like, are known to exist, there is still a need for a new and improved massage device, especially a massage device that has reduced size, bulkiness, cumbersomeness, and cost. There is also a need for a new and improved massage device that is simple in design. Further, there is a need for a massage device that can be readily attachable to a fixed vertical surface (i.e., wall-mounted) and can be readily adjustable to a desired user height. The invention illustrated in the several embodiments herein fulfills these needs and provides further related advantages.

SUMMARY OF THE INVENTION

In brief, the invention is directed to a wall-mounted massage device adapted to allow a user to self-administer a massage.

In one aspect, a wall-mounted massage device comprises a mounting member having a front surface, a rear surface opposite the front surface, a first side surface, a second side surface opposite the first side surface, a first end, and a second end opposite the first end; at least one aperture formed in the front surface of the mounting member; and at least one accessory removably mounted to the mounting member for enabling a user to self-administer a massage. The at least one accessory includes an accessory mounting part capable of being at least partially received in the at least one aperture of the mounting member for removably mounting the at least one accessory to the mounting member.

In another aspect, a wall-mounted massage device comprises a mounting member having a front surface, a rear surface opposite the front surface, a first side surface, a second side surface opposite the first side surface, a first end, and a second end opposite the first end; a plurality of apertures formed in the front surface of the mounting member; a groove formed in the rear surface of the mounting member, the groove extending a length, LG, from the second end of the mounting member such that the groove is formed over and exposes each aperture of the plurality of apertures of the mounting member; and at least one accessory removably mounted to the mounting member for enabling a user to self-administer a massage. The at least one accessory includes an accessory mounting part that is complimentary in shape with each of the plurality of apertures, thereby enabling the at least one accessory to be removably mounted to the mounting member.

BRIEF DESCRIPTION OF THE DRAWINGS

Exemplary embodiments of the invention are described in detail by the use of figures. In the figures, identically acting parts are given the same reference numbers.

DETAILED DESCRIPTION OF THE INVENTION

Figure 1:
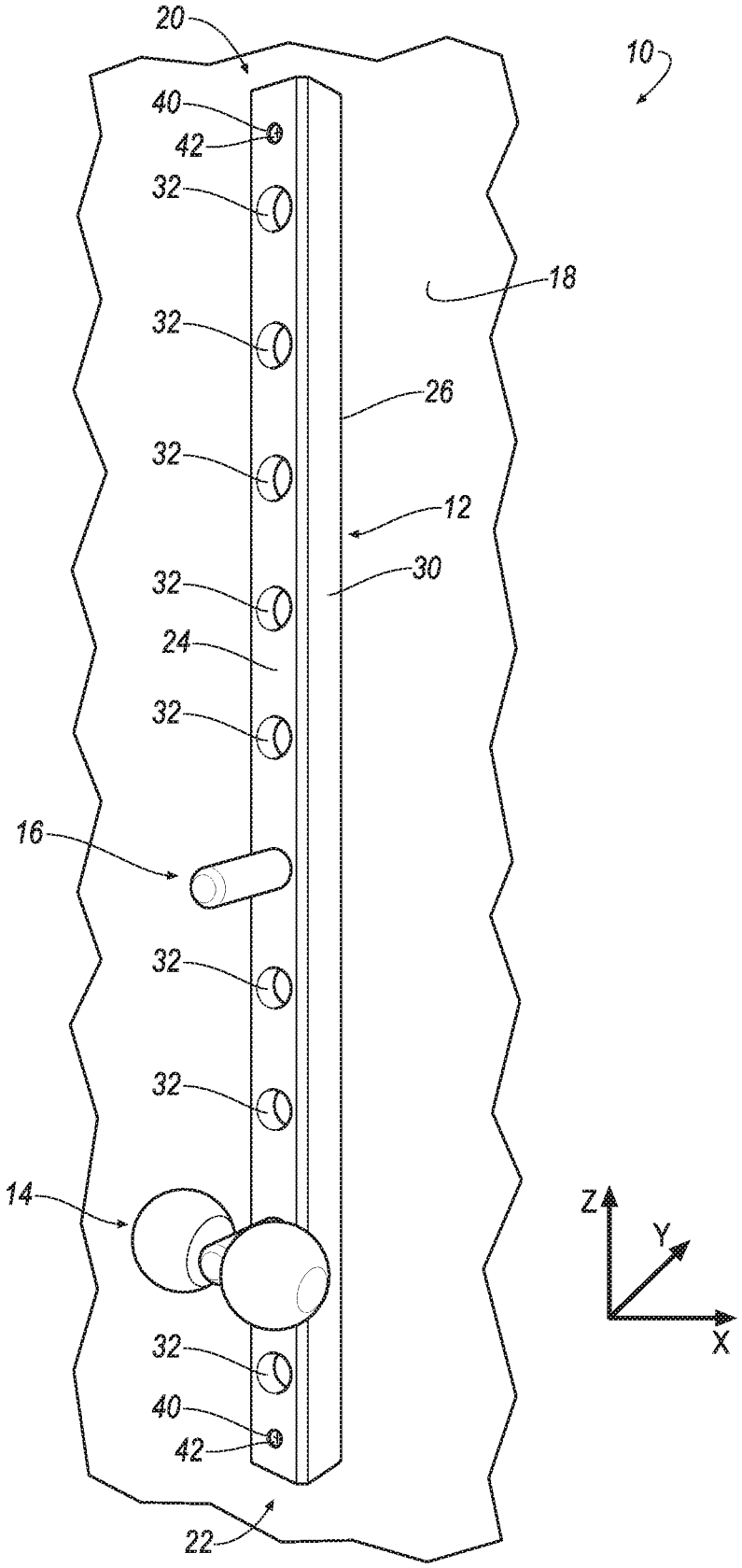
FIG. 1 is a front perspective view of a wall-mounted massage device having two accessories that are removably mounted to a mounting member according to an embodiment of the invention.

Referring now to FIG. 1, a wall-mounted massage device 10 is shown according to an embodiment of the invention. In general, the massage device 10 comprise two major components: a mounting member 12 and at least one accessory 14, 16 capable of being removably mounted to the mounting member 12. The mounting member 12 and the at least one accessory 14, 16 can be made of any suitable material, such as wood, plastic, and the like. As shown in FIG. 1, the massage device 10 is mounted to a generally vertical surface 18, such as a wall, and the like. In addition, the massage device 10 is typically mounted to the wall 18 at an appropriate height from the floor to enable a user (not shown) to stand or sit and self-administer a massage.

The description herein of specific applications should not be a limitation on the scope and extent of the use of the wall-mounted massage device.

Directional phrases used herein, such as, for example, left, right, front, back, top, bottom and derivatives thereof, relate to the orientation of the elements shown in the drawings and are not limiting upon the claims unless expressly recited therein. Identical parts are provided with the same reference number in all drawings.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Throughout the text and the claims, use of the word "about" in relation to a range of values (e.g., "about 22 to 35 wt %") is intended to modify both the high and low values recited, and reflects the penumbra of variation associated with measurement, significant figures, and interchangeability, all as understood by a person having ordinary skill in the art to which this invention pertains.

For purposes of this specification (other than in the operating examples), unless otherwise indicated, all numbers expressing quantities and ranges of ingredients, process conditions, etc., are to be understood as modified in all instances by the term "about". Accordingly, unless indicated to the contrary, the numerical parameters set forth in this specification and attached claims are approximations that can vary depending upon the desired results sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Further, as used in this specification and the appended claims, the singular forms "a", "an" and "the" are intended to include plural referents, unless expressly and unequivocally limited to one referent.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements including that found in the measuring instrument. Also, it should be understood that any numerical range recited herein is intended to include all sub-ranges subsumed therein. For example, a range of "1 to 10" is intended to include all sub-ranges between and including the recited minimum value of 1 and the recited maximum value of 10, i.e., a range having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

As used herein, the term "aperture" is defined as an opening or open space.

As used herein, the term "hole" is defined as an opening through something.

As used herein, the term "groove" is defined as a long narrow channel or depression.

As used herein, the term "peg" is defined as a small, usually cylindrical, pointed or tapered piece (as of wood) used to pin down or fasten things or to fit into or close holes.

As used herein, the term "plug" is defined as a piece used to fill a hole.

Figure 2:
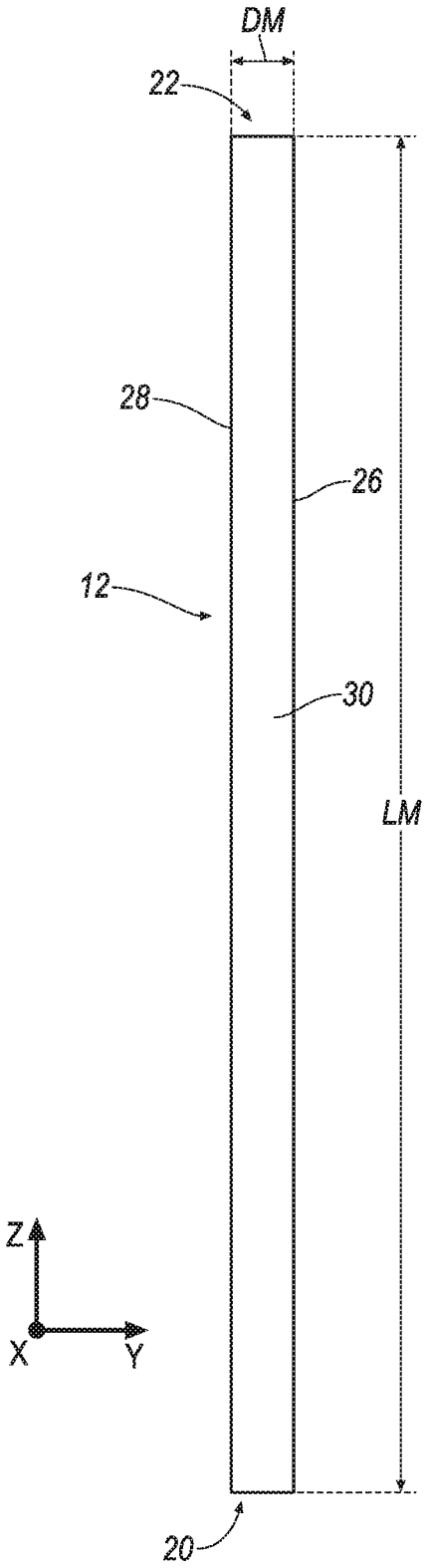
FIG. 2 is a front view of the mounting member of the wall-mounted massage device of FIG. 1.
Figure 3:
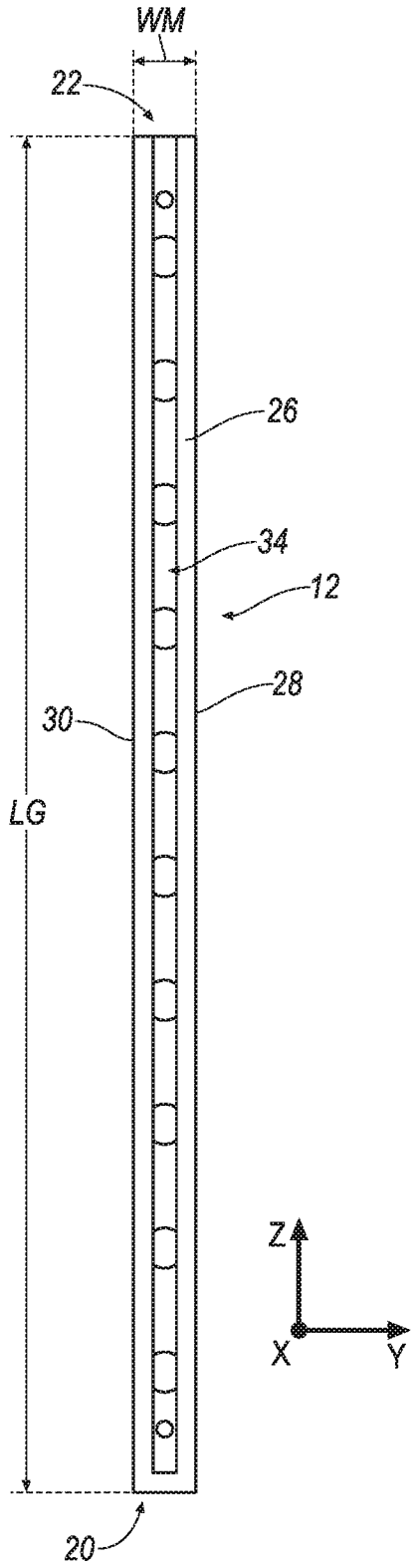
FIG. 3 is a rear view of the mounting member of FIG. 2.
Figure 4:
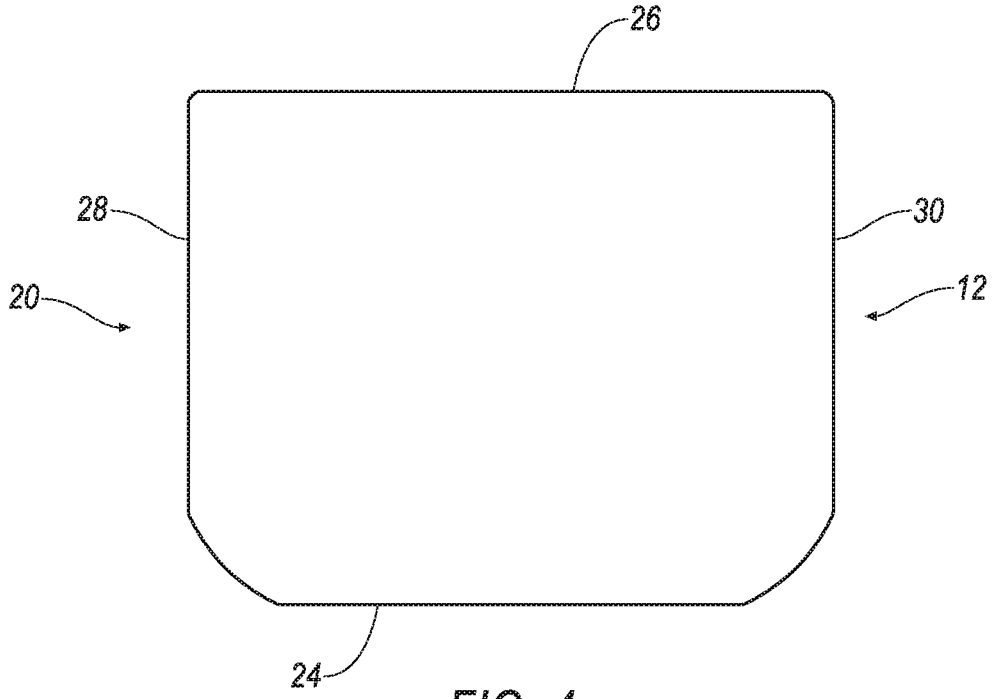
FIG. 4 is an end view of the mounting member of FIG. 2.

Referring now to FIGS. 2-7, the mounting member 12 is generally rectangular in cross-sectional shape having a first end 20 and a second end 22 opposite the first end 14. As shown in FIGS. 2 and 3, the mounting member 12 has a length, LM, a width, WM, and a depth, DM. In one embodiment, the width, WM, is greater in magnitude than the depth, DM, and the length, LM, is greater in magnitude than both the width, WM, and the depth, DM. For example, the length, LM, can be in a range between about 12 inches and 60 inches, the width, WM, in a range between about 1-2 inches, and the depth, DM, in a range between about 0.5-1.5 inch. In one embodiment, the mounting member has a width, WM, of about 1.5 inch, a depth, DM, of about 1.0 inch, and a length, LM, of about 32.0 inches. The mounting member 12 also includes a front surface 24, a rear surface 26 opposite the front surface 24, a first side surface 28 and a second side surface 30 opposite the first side surface 28.

Figure 6:
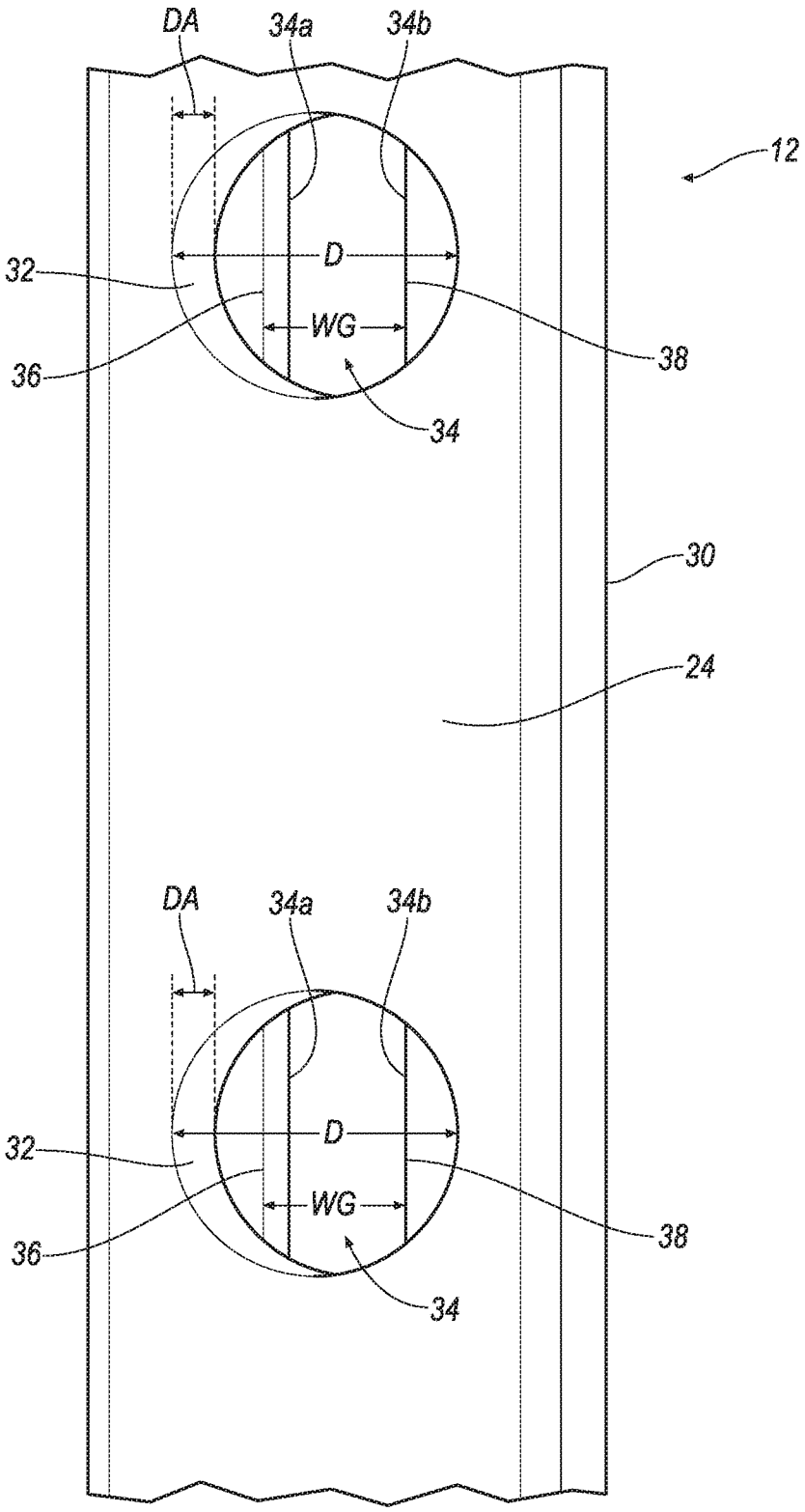
FIG. 6 is an enlarged front view of the mounting member of FIG. 2 showing the apertures or holes and stop surfaces according to an embodiment of the invention.
Figure 7:
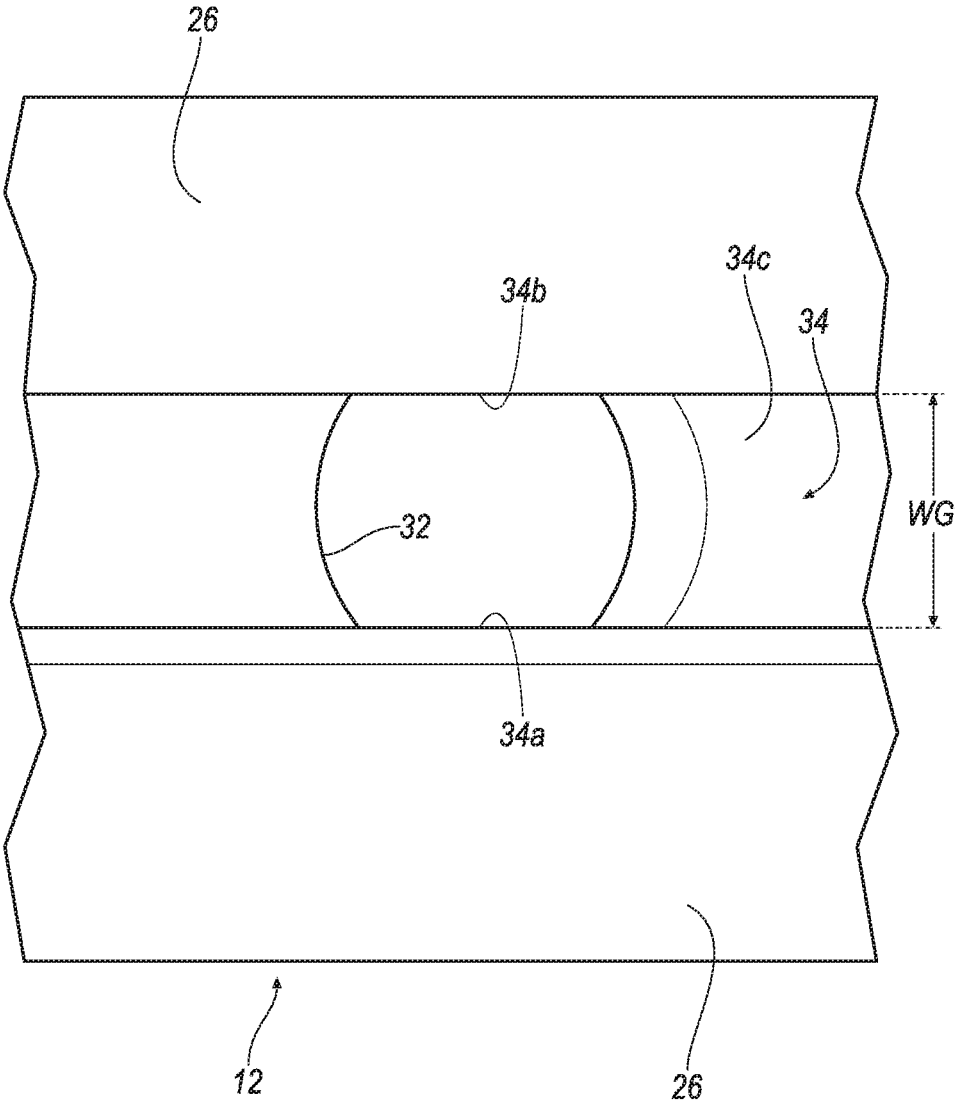
FIG. 7 is an enlarged rear view of the mounting member of FIG. 2 showing the bottom surface and opposing side surfaces of the groove according to an embodiment of the invention.

As shown in FIGS. 6 and 7, the massage device 10 includes at least one aperture or hole 32 formed in the front surface 24 of the mounting member 12. Each aperture or hole 32 has a diameter, D, and a depth, DA, as measured from the front surface 24 of the mounting member 12.

Referring back to FIG. 1, the mounting member 12 in the illustrated embodiment has a total of 10 substantially circular apertures or holes 32 equally spaced apart by about 3.0 inches from each other along the Z-axis (i.e., the vertical axis) of the mounting member 12. However, it will be appreciated that the invention is not limited by the number of apertures or holes 32, and that the invention can be practiced with any desirable number of apertures or holes 32, depending on the length, LM, of the mounting member 12. For example, the invention can be practiced with a mounting member 12 having only one aperture or hole 32 in the case of a mounting member 12 having a relatively small length, L. Oppositely, the invention can be practiced with a mounting member 12 having a plurality of apertures or holes 32 in the case of a mounting member 12 having a relatively greater length, LM.

In addition, it will be appreciated that the invention can be practiced with at least one aperture or hole 32 having a non-circular shape. For example, the at least one aperture or hole 32 can have a polygonal shape, such as a triangle, rectangle, pentagon, hexagon, heptagon, octagon, and the like, so long as the accessory 14, 16 can be removable mounted within the aperture or hole 32.

Figure 5:
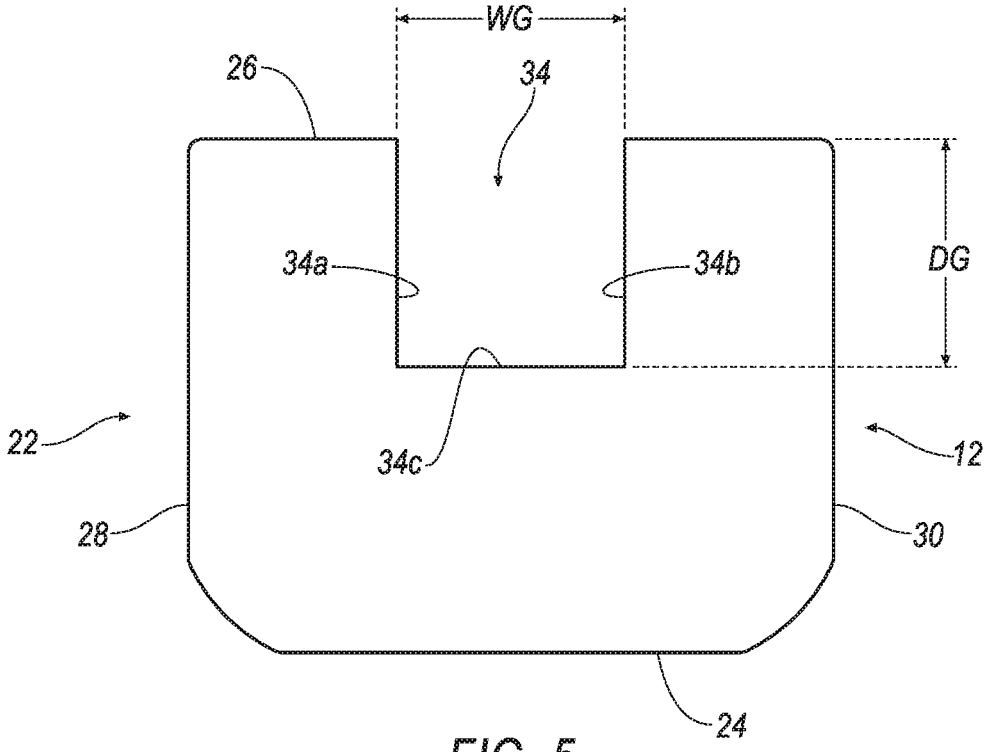
FIG. 5 is another end view of the mounting member of FIG. 2 showing a groove extending along the Z-axis (i.e., vertical axis) of the mounting member according to an embodiment of the invention.

The massage device 10 also includes a groove 34 formed in the rear surface 26 of the mounting member 12. As shown in FIGS. 5 and 7, the groove 34 has a width, WG, and a depth, DG, as measured from the rear surface 26 of the mounting member 12. In the illustrated embodiment shown in FIG. 5, the groove 34 is generally U-shaped having a first side surface 34*a*, a second side surface 34*b* facing the first side surface 34*a* and a bottom surface 34*c*. As shown in FIG. 3, the groove 34 can be formed in the mounting member 12 starting the groove 34 at one end, for example, the second end 22 of the mounting member 12 and extending the groove 34 a length, LG, along the Z-axis (i.e. vertical axis) of the mounting device 12. As shown in FIG. 3, the length, LG, of the groove 34 is less than the length, LM, of the mounting member 12, but has a sufficient length such that the groove 34 is formed over and exposes each aperture or hole 32 of the mounting member 12.

Referring back to FIGS. 6 and 7, it should be noted that the depth, DA, of each aperture or hole 32 is less than the depth, DM, of the mounting member 12 (see FIG. 2), and the diameter, DA, of each aperture or hole 32 is greater than the width, WG, of the groove 34, thereby providing a first bottom surface 36 and a second bottom surface 38 of the aperture or hole 32 and are separated by the groove 34. The first bottom surface 36 and the second bottom surface 38 act as a stop to prevent the accessory 14, 16 from extending entirely through the mounting member 12 when the accessary 14, 16 is removably mounted within a respective aperture or hole 32 of the mounting member 12. In addition, the first bottom surface 36 and the second bottom surface 38 prevent the accessory 14, 16 from unwanted movement in the axial direction (i.e., along the Y-axis) when a user self-administers a massage.

Referring back to FIG. 1, the mounting member 12 has at least one countersunk bore 40 capable of receiving a fastener 42, such as a threaded screw, a bolt, and the like. In the illustrated embodiment, the mounting member 12 includes a first countersunk bore 40 proximate the first end 20 and a second countersunk bore 40 proximate the second end 22 to securely fasten the mounting member 12 to the wall 18. It should be appreciated that the invention is not limited by the method in which the mounting member 12 is secured to the wall 18, and that the invention can be practiced with any suitable method to securely fasten the mounting member 12 to the wall 18. For example, the mounting member 12 can be securely fastened to the wall 18 by nailing, gluing, and the like.

Figure 8:
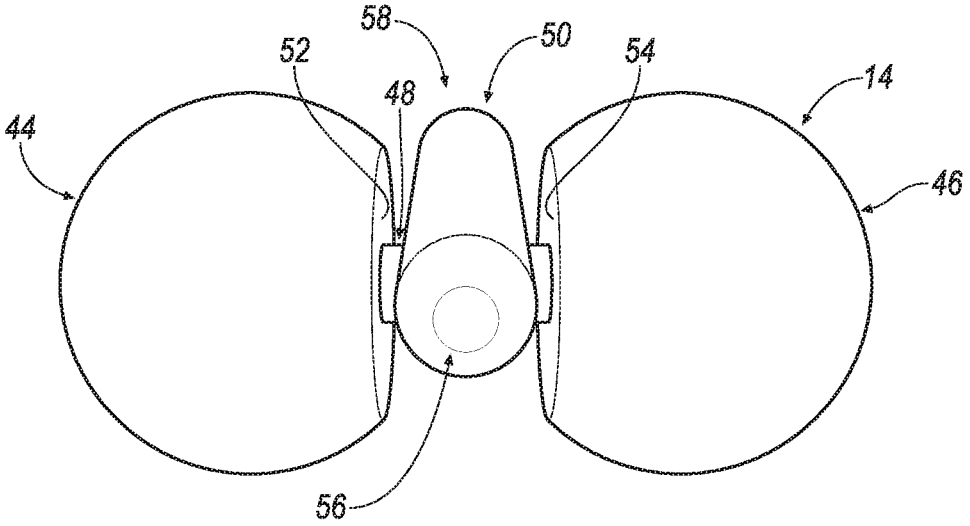
FIG. 8 is a front view of a roller assembly according to an embodiment of the invention.
Figure 9:
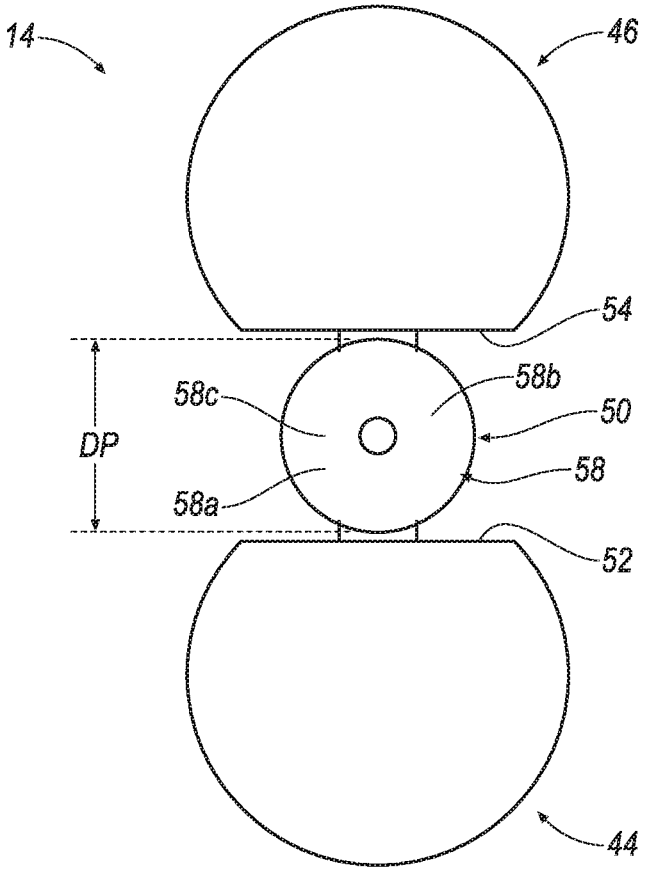
FIG. 9 is a rear view of the roller assembly of FIG. 8.
Figure 10:
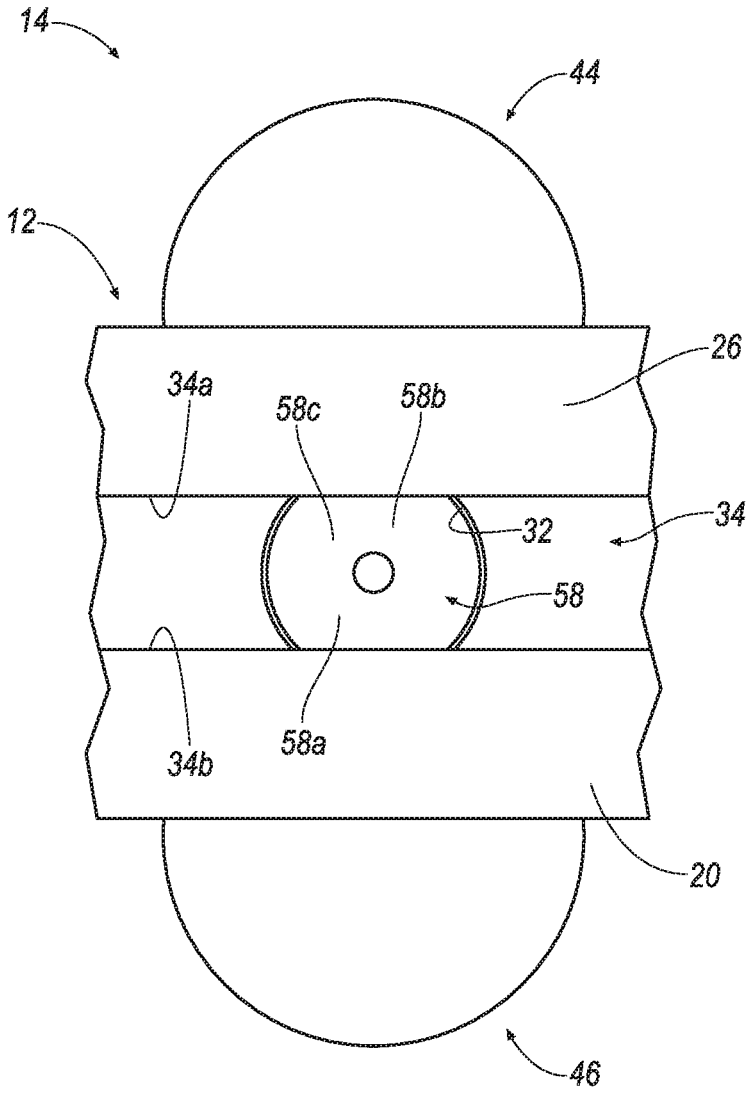
FIG. 10 is a rear view of the mounting member when the roller assembly of FIG. 8 is removably mounted to the mounting member according to an embodiment of the invention.

As mentioned above, the massage device 10 includes at least one accessory 14, 16 capable of being removably mounted within the aperture or hole 32 of the mounting member 12. Referring now to FIGS. 8-10, the accessory 14 comprising a roller assembly is shown according to an embodiment of the invention. In the illustrated embodiment, the roller assembly 14 includes a first roller 44, a second roller 46, and an axle 48 securely fastened to the first and second rollers 44, 46 and passing through an aperture in an accessory mounting part 50. The axle 48 is securely fastened to the first and second rollers 44, 46 such that rotation of the first and second rollers 44, 46 causes rotation of the axle 48. Oppositely, the axle 48 has a diameter that is slightly smaller than the diameter of the aperture in the accessory mounting part 50 such that rotation of the axle 48 by the first and second roller 44, 46 does not cause rotation of the accessory mounting part 50.

As shown in FIG. 8, the exterior surface of each of the first and second rollers 44, 46 are not entirely circular, but has inwardly facing, substantially planar exterior surfaces 52, 54, respectively. The inwardly facing planar surfaces 52, 54 allow a portion of the peg or plug 50 to be positioned between the first and second rollers 44, 46.

As mentioned above, the aperture or hole 32 has a substantially circular shape with the diameter, DA. In the illustrated embodiment, the accessory mounting part 50 comprises a peg or plug that is complimentary in shape with the aperture 32. Thus, in the illustrated embodiment, the peg or plug 50 has a substantially circular shape having a diameter, DP. Ideally, the diameter, DP, of the peg or plug 50 is slightly smaller than the diameter, DA, of the aperture or hole 32 to enable the peg or plug 50 to be easily inserted into and removed from the aperture or hole 32. In this manner, the accessory 14 is capable of being removably mounted to the mounting member 12.

It will be appreciated that the invention is not limited by the shape of the aperture 32 and the accessory mounting part 50, and that the invention can be practiced with an aperture 32 and accessory mounting part 50 having a non-circular shape, so long as the shape of the accessory mounting part 50 is complimentary to the shape of the aperture 32. For example, the aperture 32 and the accessory mounting part 50 can have a triangular shape, a rectangular shape, a pentagonal shape, a hexagonal shape, an octagonal shape, and the like.

In the illustrated embodiment, the peg or plug 50 has a first end 56 and a second end 58 opposite the first end 52. As shown in FIG. 8, the first end 56 may be rounded for aesthetic purposes. As shown in FIGS. 9 and 10, the second end 58 may have a pair of opposing beveled surfaces 58*a*, 58*b* separated by a central planar surface 58*c*. When the second end 58 of the peg or plug 50 is inserted into the aperture or hole 32, a portion of each beveled surface 58*a*, 58*b* engages the first and second side surfaces 34*a*, 34*b* of the groove 34 to facilitate removably mounting the accessory 14 to the mounting member 12.

Figure 11:
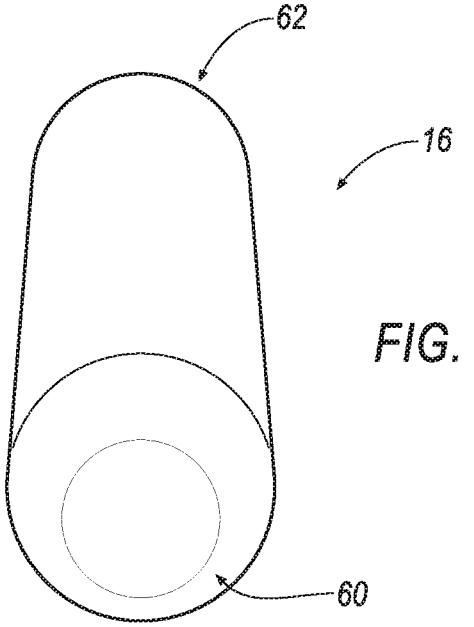
FIG. 11 is a front view of a peg for single point massage according to an embodiment of the invention.
Figure 12:
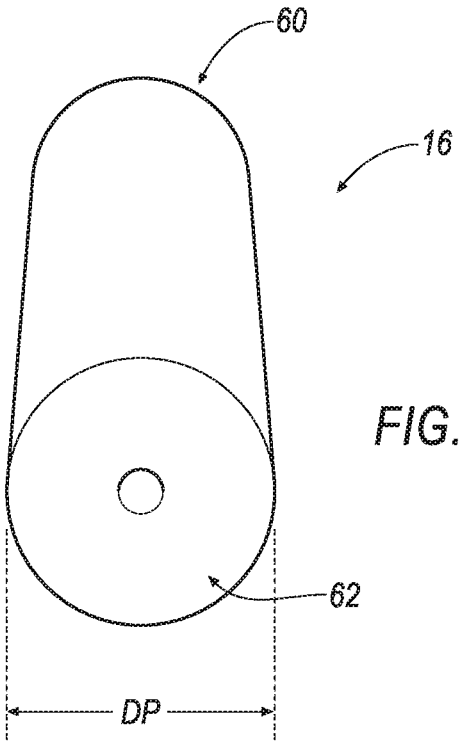
FIG. 12 is a rear view of the peg of FIG. 11.
Figure 13:
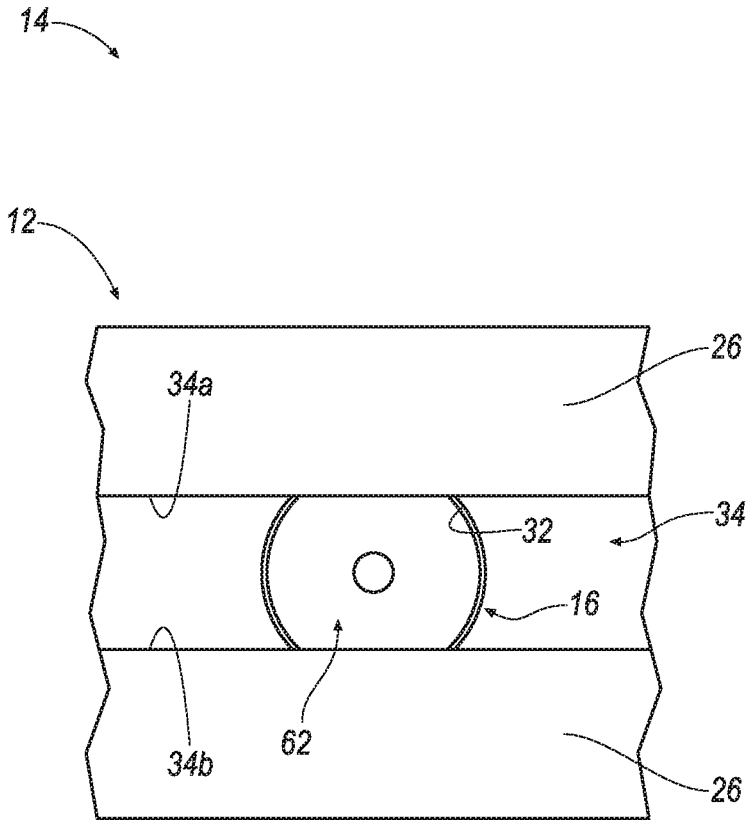
FIG. 13 is a rear view of the mounting member when the peg of FIG. 11 is removably mounted to the mounting member according to an embodiment of the invention.

Referring now to FIGS. 11-13, the accessory 16 comprises an accessory mounting part that is substantially identical to the peg or plug 50 of the accessory 14, except that the accessory 16 does not have the aperture to allow the axle 48 to pass therethrough, and the second end 62 of the accessory 16 does not have the beveled surfaces 58*a*, 58*b* of the peg or plug 50. Similar to the peg or plug 50 of the accessory 14, the accessory 16 has a first end 60 and a second end 62 is shown according to an embodiment of the invention. The accessory 16 can be removably mounted to the mounting member 12 in a similar fashion as the peg or plug 50 of the accessory 14 by simply inserting the accessory 16 into the aperture or hole 32 of the mounting member 12, thereby providing a single point massage self-administered by the user (not shown). The first end 60 of the accessory 16 can be rounded, similar to the peg or plug 50, to provide a more enjoyable single point massage experience for the user (not shown).

As described above, both accessories 14, 16 are capable of being removably mounted to the mounting member 12 by inserting at least a portion of the accessory 14, 16 into a respective aperture or hole 32 of the mounting member 12. It should be clearly understood by those skilled in the art that the massage device 10 of the invention is not limited by the type of accessory that can be removably mounted to the mounting member 12, so long as the accessory has an accessory mounting part complimentary in shape with the aperture or hole 32 such that accessory mounting part can be at least partially inserted into the aperture or hole 32 of the mounting member 12. For example, the accessory can comprise a skin brush, lotion dispenser, and the like, that includes the accessory mounting part. Other accessories that include the accessory mounting part are within the scope of this invention.

The patents and publications referred to herein are hereby incorporated by reference.

Having described presently preferred embodiments the invention may be otherwise embodied within the scope of the appended claims.

What is claimed is:

1. A wall-mounted massage device, comprising:

a mounting member having a front surface, a rear surface opposite the front surface, a first side surface, a second side surface opposite the first side surface, a first end, and a second end opposite the first end;

at least one aperture formed in the front surface of the mounting member; and at least one accessory removably mounted to the mounting member for enabling a user to self-administer a massage, wherein the at least one accessory includes an accessory mounting part capable of being at least partially received in the at least one aperture of the mounting member for removably mounting the at least one accessory to the mounting member, and a groove formed in the rear surface of the mounting member, wherein the at least one aperture has a diameter, D, and wherein the groove has a width, WG, smaller in magnitude than the diameter, D, thereby providing a first bottom surface and a second bottom surface of the at least one aperture, and wherein the first bottom surface and the second bottom surface act as a stop for preventing unwanted movement of the at least one accessory in an axial direction when the at least one accessory is removably mounted in one of the plurality of apertures.

2. The wall-mounted massage device of claim 1, wherein the at least one aperture has a depth, DA, and wherein the mounting member has a depth, DM, and wherein the depth, DA, of the at least one aperture is less than the depth, DM, of the mounting member.

3. The wall-mounted massage device of claim 2, wherein the mounting member further includes a first surface and a second surface that are separated by the groove.

4. The wall-mounted massage device of claim 2, wherein the groove is generally U-shaped having a first side surface, a second side surface facing the first side surface, and a bottom surface.

5. The wall-mounted massage device of claim 2, wherein the groove has a length, LG, and wherein the mounting member has a length, LM, and wherein the length, LG, of the groove is less than the length, LM, of the mounting member.

6. The wall-mounted massage device of claim 2, wherein the groove has a depth, DG, and wherein the mounting member has a depth, DM, and wherein the depth, DG, of the groove is less than the depth, DM, of the mounting member.

7. The wall-mounted massage device of claim 1, wherein the at least one accessory comprises a roller assembly.

8. The wall-mounted massage device of claim 7, wherein the roller assembly comprises a first roller, a second roller, and an axle securely fastened to the first roller and the second roller.

9. The wall-mounted massage device of claim 8, wherein the first roller and the second roller have inwardly facing planar surfaces that allow a portion of the accessory mounting part to be positioned between the first roller and the second roller.

10. The wall-mounted massage device of claim 8, wherein the accessory mounting part comprises a peg or plug having a first end and a second end with a first beveled surface, a second beveled surface and a central planar surface.

11. The wall-mounted massage device of claim 1, wherein the accessory mounting part comprises a peg or plug capable of being at least partially received in the at least one aperture of the mounting member for removably mounting the at least one accessory to the mounting member.

12. The wall-mounted massage device of claim 11, wherein the at least one aperture has a diameter, DA, and wherein the peg or plug has a diameter, DP, and wherein the diameter, DA of the at least one aperture is greater in magnitude than the diameter, DP, of the peg or plug to enable the peg or plug to be removably mounted to the mounting member.

13. A wall-mounted massage device, comprising:

a mounting member having a front surface, a rear surface opposite the front surface, a first side surface, a second side surface opposite the first side surface, a first end, and a second end opposite the first end;

a plurality of apertures formed in the front surface of the mounting member;

a groove formed in the rear surface of the mounting member, the groove extending a length, LG, from the second end of the mounting member such that the groove is formed over and exposes each aperture of the plurality of apertures of the mounting member; and at least one accessory removably mounted to the mounting member for enabling a user to self-administer a massage, wherein the at least one accessory includes an accessory mounting part that is complimentary in shape with each of the plurality of apertures, thereby enabling the at least one accessory to be removably mounted to the mounting member, wherein the at least one aperture has a diameter, D, and wherein the groove has a width, WG, smaller in magnitude than the diameter, D, thereby providing a first bottom surface and a second bottom surface of the at least one aperture, and wherein the first bottom surface and the second bottom surface act as a stop for preventing unwanted movement of the at least one accessory in an axial direction when the at least one accessory is removably mounted in one of the plurality of apertures.

14. The wall-mounted massage device of claim 13, wherein each aperture has a depth, DA, and wherein the mounting member has a depth, DM, and wherein the depth, DA, of each aperture is less than the depth, DM, of the mounting member.

15. The wall-mounted massage device of claim 13, wherein the groove has a depth, DG, and wherein the mounting member has a depth, DM, and wherein the depth, DG, of the groove is less than the depth, DM, of the mounting member.

16. The wall-mounted massage device of claim 13, wherein the groove has a length, LG, and wherein the mounting member has a length, LM, and wherein the length, LG, of the groove is less than the length, LM, of the mounting member.

17. The wall-mounted massage device of claim 13, wherein the groove is generally U-shaped having a first side surface, a second side surface facing the first side surface, and a bottom surface.

* * * * *